US007040387B2

(12) United States Patent
Leuthner et al.

(10) Patent No.: US 7,040,387 B2
(45) Date of Patent: May 9, 2006

(54) HEAT TRANSFER DEVICE

(75) Inventors: Stephan Leuthner, Stuttgart (DE); Petra Beil, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/088,285

(22) PCT Filed: Jun. 9, 2001

(86) PCT No.: PCT/DE01/02162

§ 371 (c)(1),
(2), (4) Date: Mar. 14, 2002

(87) PCT Pub. No.: WO02/08680

PCT Pub. Date: Jan. 31, 2002

(65) Prior Publication Data

US 2003/0094271 A1 May 22, 2003

(30) Foreign Application Priority Data

Jul. 21, 2000 (DE) ..... 100 35 939

(51) Int. Cl.
*F28F 3/00* (2006.01)
*F28F 3/08* (2006.01)

(52) U.S. Cl. ..... 165/166; 165/167; 165/906; 165/70; 165/11.2

(58) Field of Classification Search ..... 165/167, 165/906, 166, 11.2, 70, DIG. 365
See application file for complete search history.

(56) References Cited

U.S. PATENT DOCUMENTS 3,117,624 A * 1/1964 Wennerberg ..... 165/167
3,179,165 A * 4/1965 Usher et al. ..... 165/167
4,307,779 A * 12/1981 Johansson et al. ..... 165/166
4,434,643 A * 3/1984 Almqvist et al. ..... 72/379.6
4,630,674 A * 12/1986 Skoog ..... 165/147
4,635,714 A * 1/1987 Almqvist et al. ..... 165/167
4,781,248 A * 11/1988 Pfeiffer ..... 165/167
4,911,235 A * 3/1990 Andersson et al. ..... 165/167

(Continued)

FOREIGN PATENT DOCUMENTS

DE 31 52 944 C 5/1987

(Continued)

OTHER PUBLICATIONS

Patent Abstracts of Japan vol. 1996, No. 08, Aug. 30, 1996 & JP 08 110123 A, Apr. 20, 1996.

(Continued)

*Primary Examiner*—Henry Bennett
*Assistant Examiner*—Nihir Patel
(74) *Attorney, Agent, or Firm*—Michael J. Striker

(57) ABSTRACT

An apparatus for transferring heat from a first fluid to a second fluid, which is separated from the first fluid, having a stack-like or saucer-like structure comprising at least two plies (1, 2, 3), in particular plates (1, 2, 3), whereby each ply (1, 2, 3) comprises a heat-transferring area that has numerous passages (11, 12, 13), an inlet area located in front of the heat-transferring area in the direction of flow, and an exit area located behind the heat-transferring area in the direction of flow is proposed in which a relatively large heat-transferring surface area is realized in a small volume, hereby ensuring uninterrupted operation, even when the pressure differential between the two fluids is great. This is achieved according to the invention in that the inlet and/or exit area comprises at least one support element (18).

32 Claims, 3 Drawing Sheets

U.S. PATENT DOCUMENTS

| | | | | | |
|---|---|---|---|---|---|
| 4,915,165 | A | * | 4/1990 | Dahlgren et al. | 165/166 |
| 4,966,227 | A | * | 10/1990 | Andersson | 165/167 |
| 4,987,955 | A | * | 1/1991 | Bergqvist et al. | 165/167 |
| 5,174,370 | A | * | 12/1992 | Hallgren | 165/166 |
| 5,193,612 | A | * | 3/1993 | Stirnkorb | 165/167 |
| 5,226,474 | A | * | 7/1993 | Hallgren | 165/110 |
| 5,443,115 | A | * | 8/1995 | Pedersen et al. | 165/70 |
| 5,531,269 | A | * | 7/1996 | Dahlgren | 165/167 |
| 5,727,620 | A | * | 3/1998 | Schaufele et al. | 165/166 |
| 5,735,343 | A | * | 4/1998 | Kajikawa et al. | 165/153 |
| 5,864,112 | A | * | 1/1999 | Blomgren et al. | 219/121.64 |
| 5,913,361 | A | * | 6/1999 | Engstrom et al. | 165/70 |
| 5,988,269 | A | * | 11/1999 | Karlsson et al. | 165/167 |
| 6,062,305 | A | * | 5/2000 | Persson | 165/167 |
| 6,073,687 | A | * | 6/2000 | Jensen et al. | 165/167 |
| 6,164,371 | A | * | 12/2000 | Bertilsson et al. | 165/140 |
| 6,389,696 | B1 | * | 5/2002 | Heil et al. | 29/890.039 |
| 6,394,178 | B1 | * | 5/2002 | Yoshida et al. | 165/167 |
| 6,530,425 | B1 | * | 3/2003 | Wehrmann et al. | 165/167 |
| 6,629,561 | B1 | * | 10/2003 | Halt et al. | 165/167 |
| 6,662,561 | B1 | * | 12/2003 | Doty | 60/547.1 |
| 6,662,862 | B1 | * | 12/2003 | Lindholm | 165/166 |
| 6,702,005 | B1 | * | 3/2004 | Blomgren | 165/166 |
| 6,926,076 | B1 | * | 8/2005 | Blomgren | 165/167 |

FOREIGN PATENT DOCUMENTS

| | | | | |
|---|---|---|---|---|
| DE | 34 29 491 | C2 | | 3/1990 |
| EP | 0 252 275 | A | | 1/1988 |
| FR | 2 010 517 | A | | 2/1970 |
| WO | 88 09473 | A | | 12/1988 |
| WO | WO 88/09473 | | * | 12/1988 |
| WO | 96 41995 | A | | 12/1996 |

OTHER PUBLICATIONS

Patent Abstracts of Japan vol. 012, No. 055 (M-699), Feb. 19, 1988 & JP 62 200191 A, Sep. 3, 1987.

* cited by examiner

HEAT TRANSFER DEVICE

BACKGROUND OF THE INVENTION

The invention concerns an apparatus for transferring heat from a first fluid to a second fluid—which is separated from the first fluid—having a stack-like or saucer-like structure comprising at least two plies, in particular plates.

Until now, heat exchangers, for example, comprising a first passage through which a high pressure-side refrigerant flows, and a second passage—which is separated from the first passage—through which a low pressure-side refrigerant flows, are provided in a $CO_2$ vehicle air conditioner.

In order to increase the output and efficiency of the $CO_2$ process, an "inner" or "internal" heat exchanger is provided. Refrigerant ($CO_2$) flows through the internal heat exchanger in cocurrent or counterflow. According to this, the fluids flow through the heat exchanger once on the way from the vapor cooling apparatus to the evaporator and, the second time, they flow between the evaporator and the compressor. The main function of the internal heat exchanger in this context is to further cool the refrigerant before expansion. The heat is transferred from the high-pressure side [word missing] the vapor cooling apparatus to the low-pressure side after the evaporator (before it enters the compressor). The refrigerant—which is still partially liquified—evaporates completely before it reaches the compressor.

Potential applications of heat exchangers of this type include vehicle air conditioners, heat pumps, portable low-output air conditioners, air dehumidifiers, driers, fuel cell systems, and the like.

Heat exchangers that are produced relatively compact in size in order to reduce mass and volume have already been made known. In order to transfer large quantities of heat using a small design, "micro heat exchangers" are provided, for example. They comprise, in particular, structured plates stacked on top of each other and joined together via soldering, screw connection, or the like. This also seals off passages in the heat exchanger provided in appropriate fashion. The fluids that come in thermal contact with each other in the heat exchanger are conducted between the plates via the passages.

In the micro heat exchanger, the fluids are conducted into the individual plies via inlet openings or exit openings, so that a heat-absorbing and a heat-dissipating fluid flows through various plies in alternating fashion. The distribution or bringing together of the fluids into or out of the individual passages takes place in the inlet or exit area, respectively. In these areas, the respective fluid flow splits or accumulates.

An "exposed cross section" is produced where the inlet area overlaps with the exit area.

Due to the large pressure differential between the two fluids, the individual plies must be capable of withstanding the highly disparate pressure levels in the region of the exposed cross section.

The large surface area acted upon by pressure in the region of the exposed cross section causes high material tensions to occur. This can result in material deformations, e.g., flowing or failure of the component.

SUMMARY OF THE INVENTION

In contrast, the object of the invention is to propose an apparatus for transferring heat that realizes a comparably large heat-transferring surface within a small volume, hereby guaranteeing uninterrupted operation even when the pressure differential between the fluids is great.

Accordingly, an apparatus according to the invention is unusual in that the inlet and/or exit area comprises at least one support element. According to the invention, this greatly reduces the resultant exposed cross section and, in particular, the bending moment occurring in the inlet or exit area. This ensures that the area acted upon by pressure, in particular on the side operated using comparably low pressure, is supported, thereby preventing a disadvantageous deformation of the plate.

Moreover, by arranging the support elements in advantageous fashion, a support element according to the invention provided on each plate can transmit corresponding pressure forces from plate to plate until a relatively massive cover plate absorbs the pressure forces, if necessary, effectively preventing a deformation of the plates or failure of the entire component.

Numerous support elements are preferably provided in the inlet area and the exit area, further reducing the resultant exposed cross sections as well as the bending stresses that occur.

In accordance with the widening of the inlet area, the inlet area advantageously comprises comparatively numerous support elements on the side facing the heat-transferring area. Comparatively few support elements are provided on the side of the inlet area facing the inlet opening, however. A corresponding arrangement is advantageously duplicated in the exit area.

The heat exchanger according to the invention can preferably be acted upon by greater pressure differentials by reducing the material stresses as compared to a construction and design according to the related art, for example. As an alternative to this, the heat exchanger according to the invention can comprise plates having much thinner walls than those in the related art, with the identical pressure differentials. Preferably, this can lead to a marked reduction in mass and volume of the entire heat exchanger, in particular, at a given thermal output to be transferred.

The support elements increase the heat-transferring surface area in advantageous fashion, so that the heat transfer of the heat exchanger according to the invention is improved further. This allows the volume of a heat exchanger according to the invention to be reduced further in advantageous fashion at a given thermal output to be transferred.

In a particular further development of the invention, the length of the support element is designed four times greater than its width. This ensures that the support element comprises a much greater supporting effect and heat-transferring surface area at a comparable flow resistance, for example. According to the invention, this allows the heat exchanger to be acted upon in advantageous fashion by a greater pressure differential between the two fluid flows without allowing a disadvantageous material deformation or failure of the heat exchange to occur.

The support element is advantageously designed as a fluid-conducting element. This allows an improved fluid flow to be produced by means of the support elements according to the invention. Support elements according to the invention preferably allow the fluid to be distributed evenly to the passages of the heat transfer area or brought together in aerodynamic fashion as it exits the passages, and then forwarded to an appropriate common passage. This allows the passage structure of the heat transfer area be be acted upon in a more evenly-distributed fashion which, in turn, leads to improved heat transfer by the heat exchanger.

In a particular exemplary embodiment of the invention, two adjacent support elements are positioned relative to each other such that the angle ($\alpha$) between them is less than 20°, preferably between 10° and 15°. In contrast, the flare angle of the fluid flow—the "diffuser angle"—according to the related art is often greater than 50°. A comparably small flare angle according to the invention between two adjacent support elements prevents the fluid flow from separating in the inlet or exit areas, for example. This minimizes disadvantageous energy losses while preventing the passage structure of the heat transfer area from being acted upon unevenly. Another decisive aspect in this context is Reynolds' number—which is a function of the prevailing flow conditions—which depends on the flare angle, the fluid pressure, and the arrangement or design of the support elements or the passages of the heat transfer area, for example.

To improve the flow conditions, in particular, the side wall of the support element is designed linear and/or curved in shape. Designing a support element as a polygon is also feasible. The support elements are preferably designed in terms of material and geometry such that they achieve the greatest possible supportive effect and a very good flow distribution with a comparably low loss of flow pressure. If necessary, longitudinal support elements can advantageously comprise widened sections to improve the supportive effect and flow conduction.

In a particular further development of the invention, at least one support element is designed as an extension of a separating wall between two passages of the heat transfer area. This allows the passages of the heat transfer area to be acted upon much more evenly, for example.

A further improvement of the flow conduction can be achieved by arranging the support elements accordingly. If a support element is designed as an extension of the passage separating wall, a curved transition from the support element to the passage separating wall is preferably provided. A curved transition can lead to an advantageous fluid flow, so that disadvantageous pressure losses can be minimized. Not only can the support element comprise a curved side wall, but the passage separating wall can also comprise a side wall that is curved at least in the edge region, so that a more favorable fluid flow can be produced. A transition that comprises a slight bending-off that has a relatively small drop-off can also be realized.

The various plies of the stack-like or saucer-like apparatus are preferably designed as flat or arched plates or as cylindrical components that are stackable in each other due to their having different diameters, so that an advantageous production of the heat exchanger according to the invention can be realized. With the variant having flat plates, cover plates that seal off the heat exchanger are preferably provided.

Basically, the design and arrangement of the support elements are adapted to the passages in the heat transfer area. For example, the passages and the support elements are produced on or in the plies by means of a removal or deposition production method, so that the support elements and the passages can be produced relatively small in size.

Appropriate recesses in the plates are preferably produced using a photolithographic structuring process followed by an etching process, so that all method steps to produce the passages of the heat transfer area and to produce the support elements in the inlet or exit area can be realized in one working step.

In a certain exemplary embodiment, the heat exchanger is formed by means of plates that are stacked on top of each other or soldered together, in which at least some of the corresponding recesses are provided, e.g., to form the passages or support elements. At least one solder layer can be provided between the plates for a soldering process. The soldering process is advantageously carried out in a vacuum or an inert-gas atmosphere. The plates are preferably stacked on top of each other in the subsequent arrangement of the component with at least one intermediate solder layer and pressed, in the cold state in particular, before the soldering process, in fact. Pressing the plates before the actual soldering process eliminates the need to press the plates powerfully at relatively high temperatures. This eliminates the need for relatively expensive pressing tools that would have to withstand the high soldering temperatures.

BRIEF DESCRIPTION OF THE DRAWINGS

An exemplary embodiment of the invention is presented in the drawing and is explained below in greater detail using the figures.

DETAILED DESCRIPTION OF THE PREFERRED EMBODIMENTS

Figure 1:
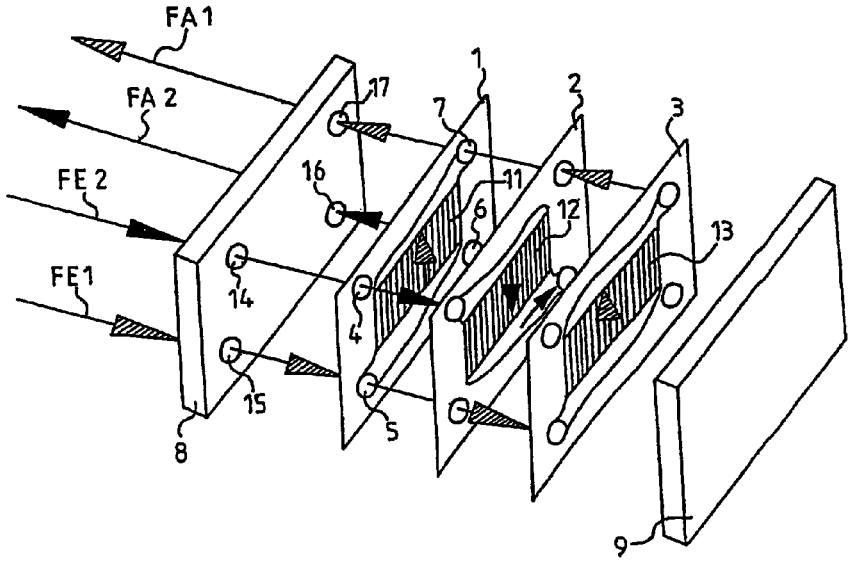
Fig. 1 PRIOR ART
FIG. 1 shows a schematic representation of the structure and flow conditions of a heat exchanger according to the related art.

A heat exchanger according to the related art is shown in FIG. 1. The heat exchanger comprises individual plates 1, 2, 3 for transferring heat, which are soldered or welded together, packed between two cover plates 8, 9, and provided with small passages 11, 12, 13 and flow openings 4, 5, 6, 7. High-pressure $CO_2$ flowing into an inlet opening 14 of the cover plate 8 (arrow FE2) flows through the flow opening 4 of the heat transfer plate 1 to the center heat transfer plate 2, flows downward through its passages 12 in the direction of the arrow and, from there, flows further through the flow opening 6 of the heat transfer plate 1 and out the exit opening 16 of the cover plate 8 (arrow FA2). As indicated by the shaded arrows, moreover, low-pressure $CO_2$ (arrow FE1) flows into the inlet opening 15 of the cover plate 8, through the passages 11 of the heat transfer plate 1 from bottom to top, then further through the flow opening 5 of the heat transfer plate 2 to the heat transfer plate 3 and, there as well, through its small passages from bottom to top and through the corresponding flow openings 7 of the heat transfer plates 3, 2, 1, and then out through the exit opening 17 of the cover plate 8 (arrow FA1).

In this fashion, high pressure-side refrigerant (black arrows) flows in a first direction through the heat exchanger shown, and low pressure-side refrigerant (shaded arrows) flows through the heat exchanger in the countercurrent.

To facilitate presentation, the heat exchanger shown in FIG. 1 only has three heat transfer plates 1, 2, 3. It comprises individual plies defined by the heat transfer plates 1, 2, 3, through which the $CO_2$ countercurrent—which is under high pressure (up to nearly 150 bar) and high temperature on the one side and, on the other side, under low pressure (up to nearly 60 bar) and low temperature—flows.

In order to adapt the heat exchanger in ideal fashion to the heat transfer conditions that occur, the fact that the heat transfer is determined by the properties of the fluid and the flow state must be taken into account. The heat-transfer coefficient on the low-pressure side is generally much smaller than that on the high-pressure side, however. In order to make the most efficient use of the volume of the heat exchanger, the basic objective is to adjust the product of heat-transfer coefficient and heat-transferring surface area on the high-pressure side to the product of heat-transfer coefficient and heat-transferring surface area on the low-pressure side. With the compact heat exchanger shown comprising individual profiles, i.e., the heat transfer plates 1, 2, 3, in which the small passages 11, 12, 13 are machined, this can take place, for example, by adjusting the hydraulic diameter of the small passages 11, 12, 13 accordingly.

Moreover, it is possible to enlarge the heat-transferring surface area or the heat-transfer coefficient of the heat transfer area by means of an appropriate flow conduction of the small passages 11, 12, 13, e.g., in a zig-zag pattern.

A heat exchanger according to the invention can be produced in advantageous fashion out of copper and copper alloy, stainless steel, aluminium, and other materials.

A heat exchanger according to the invention can be used advantageously as an inner heat exchanger of a $CO_2$ air conditioner in vehicles, especially motor vehicles.

Figure 2:
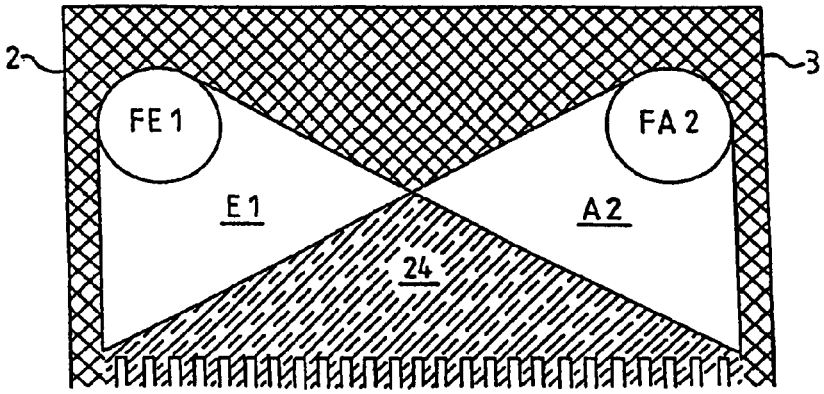
Fig. 2 PRIOR ART
FIG. 2 shows a schematic representation of an exposed cross section formed by the overlap of two plies according to the related art.

For example, the first (high-pressure) flow passage—indicated in FIG. 1 using black arrows—lies in a first flow path from a vapor-cooling apparatus to an evaporator, and the second (low-pressure) flow passage—indicated in FIG. 2 using shaded arrows—lies in a second flow path from the evaporator to a compressor of the vehicle air conditioner.

In the first flow path, a high pressure—up to nearly 150 bar—and high temperature can prevail, and, in the second flow path, a low pressure—up to nearly 60 bar—and relatively low temperature can prevail.

FIG. 2 is a schematic representation of an exposed cross section 24 created, for example, by an overlap of the inlet area E1 of the fluid l with the exit area A2 of the fluid 11 according to the related art. It becomes clear here that the exposed cross section 24 comprises a relatively large surface area acted upon by pressure and therefore must undergo high material stresses, which can lead to deformations, especially of the plates 2, 3, and to failure of the heat exchanger.

Figure 3:
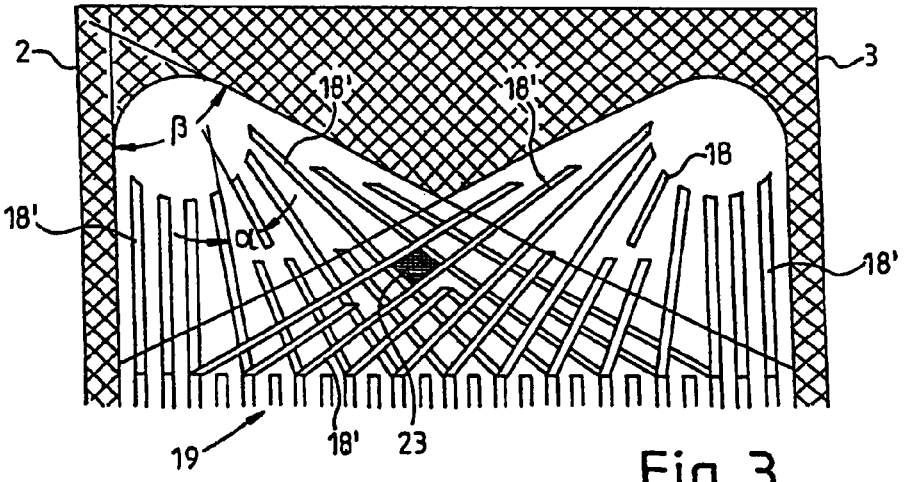
FIG. 3 shows a schematic representation of a reduced, exposed cross section according to the invention having linear support elements.

FIG. 3 shows a section of the two plates 2, 3 in accordance with the section of FIG. 2. In this case, however, the inlet or exit area of the plates 2, 3 comprise support elements 18 according to the invention. The support elements 18 according to FIG. 3 are designed as linear support elements 18. A few support elements 18' are hereby designed as extensions of a passage separating wall 19.

It furthermore becomes clear in FIG. 3 that a flare angle a formed out of two adjacent support elements 18 is much smaller than a flare angle β without—per the related art—support elements 18 according to the invention. Due to the structuring using the support elements 18, therefore, the flow of fluids is distributed more evenly to the passages of the heat transfer area, and the flare angle is reduced from approximately 50°, for example, to approximately 10° to 15°. In particular, this prevents separation of the fluid flow—which results in energy losses and the passage structure 11, 12, 13 being acted upon unevenly—to the greatest extent possible. The prevention of the separation and, therefore, the reduction in energy losses, depends mainly on the prevailing Reynolds' number. This, in turn, depends on the flare angle and the pressures of the fluids that have been set, among other things.

FIG. 3 also makes it clear that the reduced exposed cross section 23 represents a greatly reduced surface area acted upon by pressure compared to the exposed cross section 24 in FIG. 2. It therefore greatly reduces the bending stresses that occur. This prevents a deformation of the plates 1, 2, 3 or a failure of the heat exchanger to the greatest extent possible.

Figure 4:
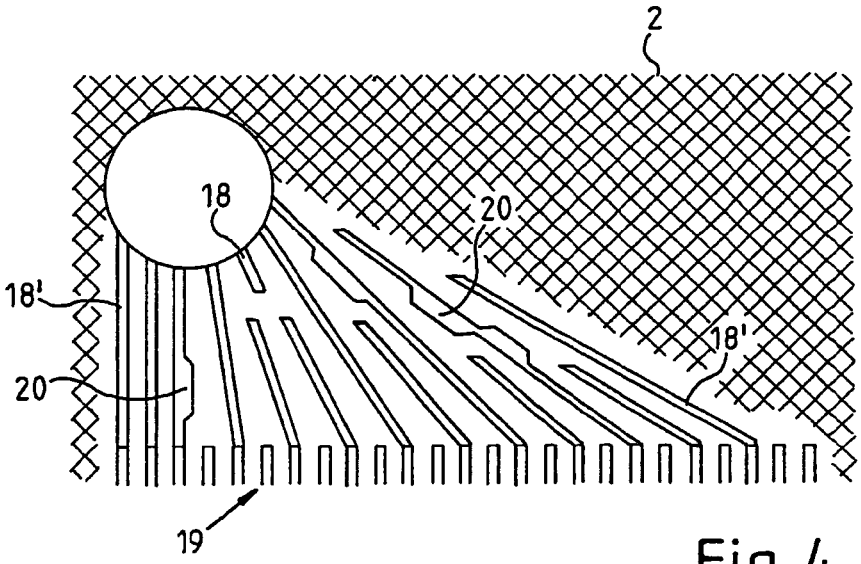
FIG. 4 shows a schematic representation of an inlet or exit area according to the invention having reinforced support elements.

Support elements 18, in particular, are shown in FIG. 4, which comprise local reinforcements 20 to reinforce the supportive effect according to the invention.

Figure 5:
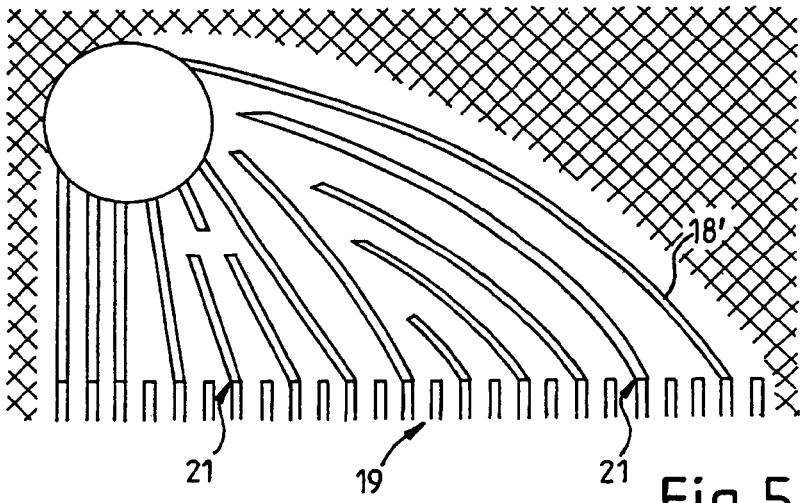
FIG. 5 shows a schematic representation of a further inlet or exit area having curved support elements.

Support elements 18 are shown in FIG. 5 that comprise a curved side wall. This design of the support elements 18 according to the invention leads, in particular, to an advantageous flow conduction and distribution of fluids to the passages 11, 12, 13. The curved support elements 18 shown in FIG. 5 comprise an angular transition 21. A curved transition 21 (not shown) can hereby lead to a further improvement of the flow conduction. With a curved transition 21, a curved end region of the passage separating walls 19 can also be advantageous.

The support elements 18 according to the invention distributed the load occurring much better; they comprise an additional load-bearing function. According to the related art, the load that occurs, among other things, had to be largely carried by the edge regions of the plates 1, 2, 3. This means that, using the support elements 18 according to the invention in the edge regions, for example, material can be advantageously spared.

Basically, a heat-absorbing fluid and a heat-dissipating fluid flow through the plates 1, 2, 3 in alternating fashion in cocurrent or counterflow. To increase the size of the heat-absorbing or heat-dissipating surface area, for example, the same fluid can hereby flow through a plurality, e.g, two, adjacent plates 1, 2, and then the other fluid flows through the subsequent plate 3 or also a plurality of adjacent plates.

REFERENCE NUMERALS

1 Plate
2 Plate
3 Plate
4 Opening
5 Opening
6 Opening
7 Opening
8 Cover plate
9 Cover plate
11 Passages
12 Passages
13 Passages
14 Opening
15 Opening
16 Opening
17 Opening
18 Support element
19 Separating wall
20 Reinforcement
21 Transition
23 Cross section
24 Cross section
FE1 Fluid Inlet I
FE2 Fluid Inlet II
FA1 Fluid Exit I
FA2 Fluid Exit II
α Angle
β Angle

What is claimed is:

1. An apparatus for transferring heat from a first fluid to a second fluid, which is separated from the first fluid, having a stack-like or saucer-like structure comprising at least two plies (1, 2, 3), in particular plates (1, 2, 3), whereby each ply (1, 2, 3) comprises a heat-transferring area that has a numerous passages (11, 12, 13), an inlet area located in front of the heating-transferring area in the direction of flow, and an exit area located behind the heat-transferring area in the direction of flow, wherein the inlet and/or exit area comprises at least one support element (18), and wherein said support element (18) is produced on or in the ply (1, 2, 3) by means of a removal or deposition production method, wherein said support elements (18) of two adjacent plies (1, 2, 3) extend in intersecting directions to reduce the exposed cross section (23) between two plies and therefore to reduce the bending stresses on the plies (1, 2, 3) in their inlet and exit area.

2. The apparatus according to claim 1, wherein the length of the support element is designed multiple greater than its width.

3. The apparatus according to claim 1, wherein the support element (18) is designed as a fluid-conducting element (18).

4. The apparatus according to claim 1, wherein two adjacent support elements (18) are positioned relative to each other such that the angle ($\alpha$) between them is less than 20°.

5. The apparatus according to claim 1, wherein the side wall of the support element is designed linear and/or curved in shape.

6. The apparatus according to claim 1, wherein at least one support element (18) is designed as an extension of a separating wall (19) between two passages.

7. The apparatus as defined in claim 1, wherein a curved transition (21) from the support element (18) to the separating wall (l9) is provided.

8. The apparatus according to claim 1, wherein the plies (1, 2, 3) are designed as flat or arched plates (1, 2, 3) or components (1, 2, 3) that are cylindrical in shape and stackable in each other due to their haven different diameters.

9. An apparatus for transferring heat from a first fluid to a second fluid, which is separated from the first fluid, having a stack-like or saucer-like structure comprising at least two plies (1, 2, 3), in particular plates (1, 2, 3), whereby each ply (1, 2, 3) comprises a heat-transferring area that has numerous passages (11, 12, 13), an inlet area located in front of the heat-transferring area in the direction of flow, and an exit area located behind the heat-transferring area in the direction of flow, wherein the inlet and/or exit area comprises at least one support element (18), and wherein said support element (18) and said passages (11, 12, 13) are produced on or in the ply (1, 2, 3) by means of a removal or deposition production method, wherein said support elements (18) of two adjacent plies (1, 2, 3) extend in intersecting directions to reduce the exposed cross section (23) between two plies and therefore to reduce the bending stresses on the plies (1, 2, 3) in their inlet and exit area.

10. The apparatus according to claim 9, wherein the length of the support element is designed multiple greater than its width.

11. The apparatus according to claim 9, wherein the support element (18) is designed as a fluid-conducting element (18).

12. The apparatus according to claim 9, wherein two adjacent support elements (18) are positioned relative to each other such that the angle ($\alpha$) between them is less than 20°.

13. The apparatus according to claim 9, wherein the side wall of the support element is designed linear and/or curved in shape.

14. The apparatus according to claim 9, wherein at least one support element (18) is designed as an extension of a separating wall (19) between two passages.

15. The apparatus as defined in claim 9, wherein a curved transition (21) from the support element (18) to the separating wall (19) is provided.

16. An apparatus for transferring heat from a first fluid to a second fluid, which is separated from the first fluid, having a stack-like or saucer-like structure comprising at least two plies (1, 2, 3), in particular plates (1, 2, 3), whereby each ply (1, 2, 3) comprises a heat-transferring area that has numerous passages (11, 12, 13), an inlet area located in front of the heat-transferring area in the direction of flow, and an exit area located behind the heat-transferring area in the direction of flow, wherein the inlet and/or exit area comprises at least one support element (18), and wherein said support element (18) is produced on or in the ply (1, 2, 3) by means of an etching process, wherein said support elements (18) of two adjacent plies (1, 2, 3) extend in intersecting directions to reduce the exposed cross section (23) between two plies end therefore to reduce the bending stresses on the plies (1, 2, 3) in their inlet and exit area.

17. The apparatus according to claim 9, wherein the plies (1, 2, 3) are designed as flat or arched plates (1, 2, 3) or components (1, 2, 3) that are cylindrical in shape and stackable in each other due to their haven different diameters.

18. The apparatus according to claim 16, wherein the length of the support element is designed multiple greater than its width.

19. The apparatus according to claim 16, wherein the support element (18) is designed as a fluid-conducting element (18).

20. The apparatus according to claim 16, wherein two adjacent support elements (18) are positioned relative to each other such that the angle ($\alpha$) between them is less than 20°.

21. The apparatus according to claim 16, wherein the side wall of the support element is designed linear and/or curved in shape.

22. The apparatus according to claim 16, wherein at least one support element (18) is designed as an extension of a separating wall (19) between two passages.

23. The apparatus as defined in claim 16, wherein a curved transition (21) from the support element (18) to the separating wall (19) is provided.

24. An apparatus for transferring heat from a first fluid to a second fluid, which is separated from the first fluid, having a stack-like or saucer-like structure comprising at least two plies (1, 2, 3), in particular plates (1, 2, 3), whereby each ply (1, 2, 3) comprises a heat-transferring area that has numerous passages (11, 12, 13), an inlet area located in front of the heat-transferring area in the direction of flow, and an exit area located behind the heat-transferring area in direction of flow, wherein the inlet and/or exit area comprises at least one support element (18), and wherein said support element (18) and said passages (11, 12, 13) are produced on or in the ply (1, 2, 3) by means of an etching process, wherein said support elements (18) of two adjacent plies (1, 2, 3) extend in intersecting directions to reduce the exposed cross section (23) between two plies and therefore to reduce the bending stresses on the plies (1, 2, 3) in their inlet and exit area.

25. The apparatus according to claim 16, wherein the plies (1, 2, 3) are designed as flat or arched plates (1, 2, 3) or components (1, 2, 3) that are cylindrical in shape and stackable in each other due to their haven different diameters.

26. The apparatus according to claim 24, wherein the length of the support element is designed multiple greater than its width.

27. The apparatus according to claim 24, wherein the support element (18) is designed as a fluid-conducting element (18).

28. The apparatus according to claim 24, wherein two adjacent support elements (18) are positioned relative to each other such that the angle ($\alpha$) between them is less than 20°.

29. The apparatus according to claim 24, wherein the side wall of the support element is designed linear and/or curved in shape.

30. The apparatus according to claim 24, wherein at least one support element (18) is designed as an extension of a separating wall (19) between two passages.

31. The apparatus as defined in claim 24, wherein a curved transition (21) from the support element (18) to the separating wall (19) is provided.

32. The apparatus according to claim 24, wherein the plies (1, 2, 3) are designed as flat or arched plates (1, 2, 3) or components (1, 2, 3) that are cylindrical in shape and stackable in each other due to their haven different diameters.

* * * * *